US009424735B2

(12) United States Patent
Haidegger et al.

(10) Patent No.: US 9,424,735 B2
(45) Date of Patent: Aug. 23, 2016

(54) METHOD AND APPARATUS FOR HAND DISINFECTION QUALITY CONTROL

(75) Inventors: Tamas Haidegger, Budapest (HU); Melinda Nagy, Targu Mures (RO); Akos Lehotsky, Budapest (HU); Laszlo Szilanyi, Szigetszentmiklos (HU)

(73) Assignee: BUDAPESTI MUSZAKI ES GAZDASAGTUDMOANYI EGYETEM, Budapest (HU)

( * ) Notice: Subject to any disclaimer, the term of this patent is extended or adjusted under 35 U.S.C. 154(b) by 542 days.

(21) Appl. No.: 13/824,240

(22) PCT Filed: Sep. 23, 2011

(86) PCT No.: PCT/HU2011/000094

§ 371 (c)(1),
(2), (4) Date: May 7, 2013

(87) PCT Pub. No.: WO2012/042285

PCT Pub. Date: Apr. 5, 2012

(65) Prior Publication Data

US 2013/0215245 A1 Aug. 22, 2013

(30) Foreign Application Priority Data

Sep. 27, 2010 (HU) ..... 1000523

(51) Int. Cl.
*G08B 21/24* (2006.01)

(52) U.S. Cl.
CPC ..... *G08B 21/245* (2013.01); *G08B 21/24* (2013.01)

(58) Field of Classification Search
CPC .... G08B 21/245; G08B 21/24; A61L 2/0029; A61L 2/0047; A61L 2/0058; A61L 2/24; A61L 2/26; A61L 2/28
See application file for complete search history.

(56) References Cited

U.S. PATENT DOCUMENTS 5,135,721 A * 8/1992 Richard ..... A61B 19/36 118/300
5,631,976 A * 5/1997 Bolle ..... G06T 5/50 348/E5.038
5,670,945 A * 9/1997 Applonie ..... G08B 21/245 340/540

(Continued)

FOREIGN PATENT DOCUMENTS

JP 2006 300810 A 11/2006
WO WO 2005/093681 A1 10/2005

*Primary Examiner* — Regina M Yoo
(74) *Attorney, Agent, or Firm* — Birch, Stewart, Kolasch & Birch, LLP

(57) ABSTRACT

Method and apparatus for hand disinfection quality control comprising the steps of providing hand disinfection medium comprising light reflecting particles responsive to light mostly outside the visible spectral range of light, applying the hand disinfection medium comprising the light reflecting particles in a prescribed manner for a prescribed time, illuminating the disinfected hands with a light source providing light in a spectral range for activating the reflecting particles. The method further comprises providing digital images of the hands from both sides, determining the concentration of reflecting particles, comparing determined concentration values with a predetermined threshold value corresponding to acceptable hand cleanness, and determining whether the quality of disinfection is acceptable or not according to the result of comparison. In the method according to the invention for each person individual threshold value is stored, and the concentration value determined during measuring is compared with the individual threshold value.

16 Claims, 3 Drawing Sheets

(56) References Cited

Figure 1:
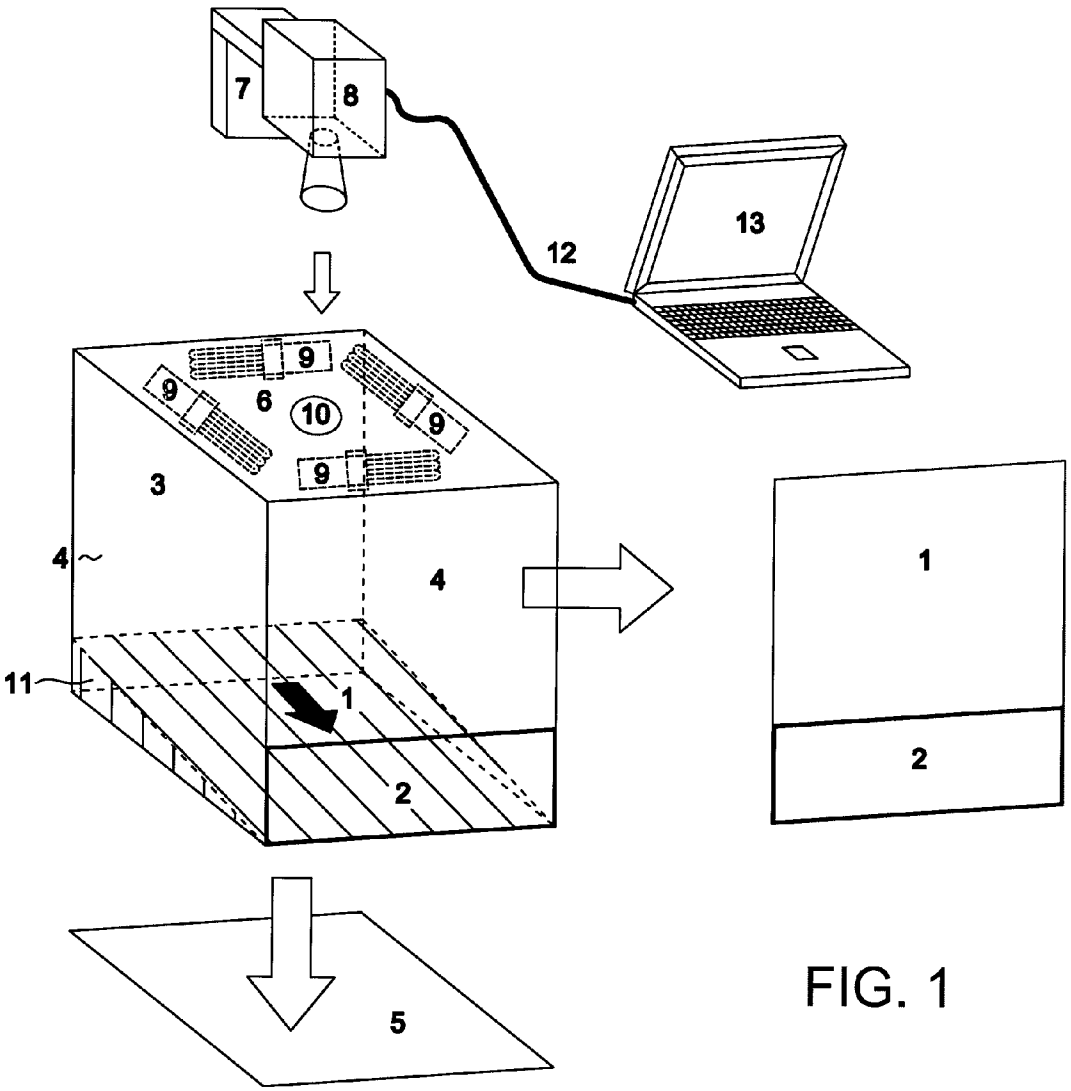

U.S. PATENT DOCUMENTS 5,942,759 A * 8/1999 Romano ..... G01N 21/6447 250/461.1
6,038,331 A * 3/2000 Johnson ..... G06K 9/00375 134/113
6,110,292 A * 8/2000 Jewett ..... A61L 2/0088 128/DIG. 1
6,431,189 B1 8/2002 Deibert
7,443,305 B2 * 10/2008 Verdiramo ..... G08B 21/245 340/4.62
7,542,586 B2 * 6/2009 Johnson ..... G06K 9/00375 348/143
8,110,047 B2 * 2/2012 Glenn ..... B08B 3/04 134/18
2009/0314308 A1 * 12/2009 Kim ..... A61L 2/0047 134/1

* cited by examiner

LEFT

FRONT

INSIDE-TOP

TOP

METHOD AND APPARATUS FOR HAND DISINFECTION QUALITY CONTROL

This application is the National Phase Under 35 U.S.C. §371 of PCT International Application No. PCT/HU2011/000094 which has an International filing date of Sep. 23, 2011, which claims priority to Hungarian Patent Application No. P 1000523 filed on Sep. 27, 2010. The entire contents of all applications listed above are hereby incorporated by reference.

TECHNICAL FIELD

The invention relates to a method and apparatus for hand disinfection quality control.

BACKGROUND OF THE INVENTION

Hospital acquired infections (HAI) are the $4^{th}$ leading cause of death in the United States, and claims 15,000 lives annually in Europe. One of the major sources of HAI is the improper hand disinfection of the medical staff. HAI (also called nosocomial infections) generate unnecessary expenses, and also reduces the quality of life of the patients. It prolongs recovery and promotes the resistance of pathogens against antibiotics.

The applied methods of hand disinfection have been widely discussed in recent studies such as in BERHE M., EDMOND M. and BEARMAN G., "Measurement and feedback of infection control process measures in the intensive care unit: impact on compliance", Amer. J. Infection Contr., vol. 34, no. 8, 2006, pp. 537-539. and in ROSENTHAL V., GUZMAN S. and SAFDAR N., "Reduction in nosocomial infection with improved hand hygiene in intensive care units of a tertiary care hospital in Argentina", Amer. J. Infection Contr., vol. 33, no. 7, 2005, pp. 392-397. These processes are now regulated by European and U.S. standards such as reported by GORONCY-BERMES P., "Hand disinfection according to the European Standard EN 1500 (hygienic handrub): a study with Gram-negative and Gram-positive test organisms". Int. J. Hyg. Environ. Health vol. 204, 2001, pp. 123-126. and by BOYCE J. M. and PITTET D., "Guideline for hand hygiene in healthcare settings: recommendations of the Healthcare Infection Control Practices Advisory Committee and HICPAC/SHEA/APIC/IDSA Hand Hygiene Task Force", Morbidity and Mortality Weekly Report, vol. 51, no. 16, 2002, pp. 1-45. Despite the numerous automated disinfection stations and the spread of antibacterial soaps, the insufficient hand washing remains a major problem in health care and causes several infection-related problems at general households as well. In the medical environment, appropriate hand disinfection is required to keep HAI rates low, especially as the new mutant germs—such as the NDM-1—show high resistance to antibiotic treatment. In general practice however, proper hand hygiene helps to maintain a healthy life, and to prevent or reduce the spread of epidemics (SARS, H1N1 and so).

In 2009, the health care costs directly related to HAIs were about 40 billion dollars in the U.S. and it is increasing each year, causing permanent damage and even death in the most serious cases. It has been shown that at least 30% of these infections could be prevented as reported by KAMPF G, "The six golden rules to improve compliance in hand hygiene", Archives Journal of Hospital Infection, Volume 56, Supplement 2, April 2004, pp. 3-5 and by PITTET D., MOUROUGA P et al., "Compliance with handwashing in a teaching hospital", Ann Inter Med. 2002, pp. 126-130. The fight against HAI begins at the medical workers' hand hygiene. A major study by the Association for Professionals in Infection Control and Epidemiology, Inc. et al., "Measuring hand hygiene adherence: Overcoming the challenges". WHO Report, 2009 (http://www.jointcommission.org/NR/rdonlyres/68B9CB2F-789F-49DB-9E3F-2FB387666BCC/0/hh_monograph.pdf) concluded, based on 96 publications addressing hand hygiene, that overall hand hygiene adherence rate is 40 percent among health care workers.

Up to now, there have only been limited solutions developed to support health care institutes with technology-aided quality control of hand disinfection. Ultraviolet reflective gels are available to simulate germs, and to demonstrate proper hand washing by removing the reflective material, which is known as Glo Germ Medium Powder Kits (http://www.sellesmedical.co.uk/store/product/3262-Glo-Germ-Medium-Powder-Kits). Ultraviolet light is used in general cleaning (U.S. Pat. No. 7,718,395) to spot for urine and phosphate particles especially. Occasionally, hand washing quality is checked under UV lighting, but only verified by the naked eye, and performed for marketing purposes (U.S. Pat. Nos. 6,524,390, 5,900,067). Most systems are available to track to spatial motion of the medical staff, and record the time they spend e.g. in the sanitary station (U.S. Pat. Nos. 7,443,305, 7,616,122) or the use of the disinfection gels (U.S. Pat. No. 6,392,546). Software solutions did get developed to support the registration of hand washing events (e.g. iScrub Lite iPhone and iPad app, https://compepi.cs.uiowa.edu/iscrub/home/), however, these require manual data input. The only device that tries to verify the disinfection is the Hygreen system from Xhale tech. Inc. (U.S. Pat. Nos. 7,755,494, and 7,551,092) also published on Internet (www.xhale.com/hygreen/), but it is only capable of determining the presence of alcohol scent on the hand (U.S. Pat. No. 7,755,494) that is absolutely no guarantee for adequate disinfection. Similar solutions have been developed for general cleaning verification in the food industry (U.S. Pat. No. 6,038,331), relying on colored soap detection on the hand or other surfaces.

DISCLOSURE OF THE INVENTION

The subject of the invention is a device that is capable of accurately and objectively identifying the disinfected areas on a hand and determining the overall quality of the hand washing in accordance with sanitization requirements.

The invention on one hand is based on a method for hand disinfection quality control comprising the steps of

- providing a hand disinfection medium comprising a light reflecting particles responsive to light mostly outside the visible spectral range of light,
- applying the hand disinfection medium comprising the light reflecting particles in a prescribed manner for a prescribed time,
- illuminating the hands disinfected this way with a light source providing light in a spectral range for activating the reflecting particles. The improvement according to the invention further comprises the steps of
- providing digital images of the hands from both sides, and
- evaluating the images by a computer program in order to determine the cleanness of the hands.

According to an alternative embodiment, the image is filtered in order to obtain different spectral images, wherein one of the filtered images is used for determining the regions of interest within the image for further analysis, and at least one of the other images is used for determining the concentration of reflecting particles.

In a further embodiment, the concentration value of the reflecting particles is compared with a predetermined value of acceptable hand cleanness and a report is generated based on the comparison.

In order to carry out a real time analysis or any later analysis, it is preferred that the obtained images, the determined values of concentration of the reflective particles and the quality control result, are stored on a storage means.

In an alternative embodiment, for each person a first set of data, comprising hand images, concentration values before disinfection procedure and a second set of data comprising hand images, concentration values after disinfection procedure are stored on the storage means.

In order to enhance accuracy of the quality control, it may be advantageous if for each person individual threshold values are stored to be compared with the values determined during measuring.

The invention relates also to an apparatus for implementing the method and assessing hand disinfection quality. The invention uses an apparatus that comprises a rigid case with side walls connected to each other. The case encloses a light source for providing light of a predetermined spectral range mostly outside the visible range. The case is further provided with an opening on the front wall for introducing the hands to be exposed to the light of the light source. According to the improvement of the invention, an imaging device is attached to the case for taking images of the illuminated hands. The imaging device is connected to a computer, which is used for storing images, predetermined values to be compared with the images or with values derived from the images, and a computer program for controlling the measurement and evaluation process.

The apparatus of the invention is provided with at least two light sources arranged inside the rigid case in order to provide homogeneous illumination.

The light sources that may be applied in connection with the invention may be selected from a wide variety of UV lamps, UV LEDs, IR lamps or IR LEDs.

In order to improve the image quality and for excluding disturbing light from the environment, that the walls of the rigid case may be not transparent to light. The inside surface of the walls of the rigid case may be alternatively black and non-reflecting.

In a further embodiment of the invention an inclined surface is applied to the bottom surface for supporting the hands. The inclined surface may have an inclination angle of about 10 degrees relative to the bottom surface. It may also be preferred to cover the inclined surface with a black non-reflective sheet.

A further alternative embodiment of the apparatus may be designed so that the rigid case is a wall mounted case, wherein the bottom may be removable.

SHORT DESCRIPTION OF THE DRAWINGS

Figure 3:
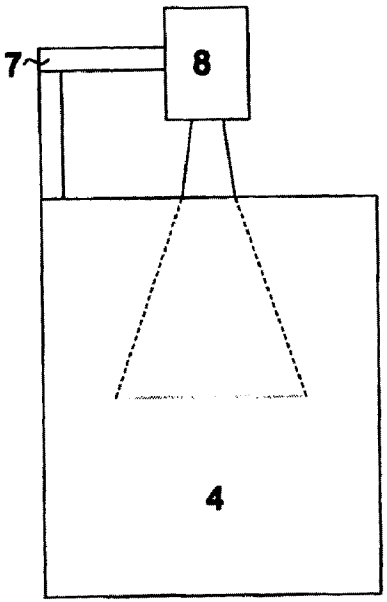
Figure 2:
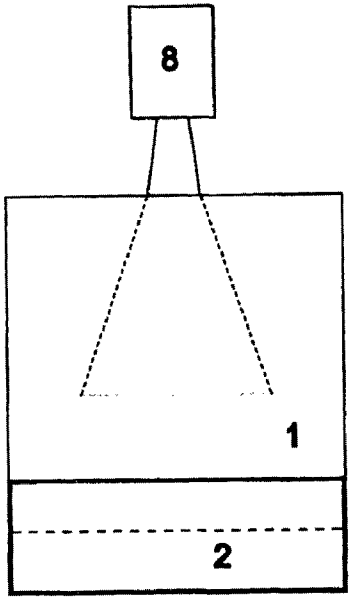
Figure 5:
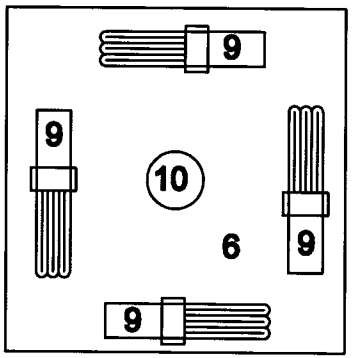
Figure 4:
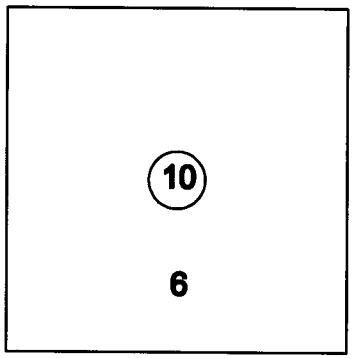

Further objects, modifications, improvements will be clear from the description below in conjunction with the attached drawings, in which:

FIG. 1 is a schematic block diagram showing the major system element of the apparatus according to the invention, FIG. 2 is a front view of the apparatus of FIG. 1, FIG. 3 is a left side vies of the apparatus of FIG. 1, FIG. 4 is a top view of the apparatus of FIG. 1, and FIG. 5 is an inside view of the top wall of the apparatus of FIG. 1.

The objective of the invention is to provide a compact, mobile tool for the objective assessment of hand disinfection quality. The setup consists of a rigid box 1-6 with built-in UV lighting 9, a digital camera 8 and an attached notebook 13 (FIG. 1-3). The whole system requires regular line voltage such as a 230V connection, feeding a total power of ~120 W.

The size of the rigid case was chosen so as to provide the opportunity for dual hand imaging (preferred size may be W=330, L=330, H=350 mm). It may be made of a light metal, such as aluminum, or any plastic material with similar properties to ensure rigidity, but facilitate mobility due to the light overall weight. The matt (non-reflecting) black interior of the case helps to reduce the environmental disturbing effects during image acquisition. The whole case is wall mountable with small hooks (the bottom cover 5 should be removed in this case), or can be used on a desk. (The device is illustrated in FIG. 1.)

In the middle region of the top cover an opening 10 is provided for receiving a camera 8 that is attached to the casing (box) through a small adjustable fixing element 7. Four 22 W UV fluorescent lamps 9 are mounted around it, providing equal illumination within the inner volume of the case and therefore on the surface of a hand inserted into the case. Alternatively, the light tubes can be replaced with UV LED-s which results in reduced energy consumption. The arrangement of the compact light sources was optimized to reduce the presence of shadows. Fluorescent lights emit ultraviolet radiation due to the peak emission of the mercury within the tube. These should be CE marked regular compact UV tubes that pose no health risk at this power.

The original practice of hand washing is kept untouched, only UV-reflective powder is mixed with the regular alcohol-based liquid soap. Alternatively, infrared reflective powder can also be used paired with IR-A illumination (700-1000 nm), or fluorescent reagent (<350 nm), as long as they have no associated health risk and they do not interfere with the soap.

The employed workflow is the following: hand washing is performed with the treated soap mix, which appears brighter on sterile surfaces (having sufficiently treated with the soap). The specification of the original soap material guarantees the effectiveness of the disinfection. (E.g. in the United States, these are described for every reagent individually in the Food and Drug Administration's (FDA) Tentative Final Monographs.) Pictures of the hand are taken in the UV-lighted box with a wide angle digital camera 8 mounted on the case. The camera can be triggered either by a motion sensor, directly attached to it, or by the software running on the notebook. The palm and the top of the hand are recorded one after the other. The camera should be able to take the images in the reduced light environment within ⅛ of a second to avoid motion blur. The images are transmitted to a regular portable computer, such as a notebook 13 through wired (USB) 12 or wireless connection (WiFi, Bluetooth or ZigBee), and the computer performs an automatic evaluation procedure, providing images that highlights clean versus dirty areas, and indicates an overall quantitative score for the hand washing.

When used in a table-top arrangement—in order to keep the interior of the box clean from the humid hand—disposable matt black papers may be used. The hand must be placed on a specific area, a slightly (~10°) tilted hand rest 11 that helps to keep the palm flat for imaging, and it is also more ergonomic for the user as well. The focus of the camera is on the whole hand, and the digital images are taken with fixed aperture and exposure time, controlled by the computer.

In order to assure an acceptable speed of image processing (in the order of a few seconds), the captured RGB images are downsized (without significantly affecting the segmentation accuracy), then filtering is applied. Out of the three intensity channels (corresponding to red, green and blue), one is used for finding the region of interest (segmenting the entire hand) and another for image processing, to classify the pixels (segmenting the clean areas). In order to separate the pixels belonging to clean and untreated regions of the hand, a quick segmentation algorithm was applied that is fed with the histogram of the single-channel input image. Finally, pixel- and region-based filtering and weighting are used to create the results: a visual overlay of the clean areas and the entire hand, along with the numeric details, the percentage of the clean areas relative to the hand surface and the objective quality score for the whole hand disinfection. These are unambiguously displayed on the computer screen. Optional sound effects can be assigned to pass/fail events.

Used in a health care institute's environment, beyond visual display of the results, the data may be recorded in a central database, therefore the notebook must be compatible with the general Hospital Information System. Every user would have a statistic over their hand washing performance available.

It may be useful to build an initial database of the typical user's hand to calibrate the algorithm for every individual's hand and skin properties (such as color, birth marks, vessels, etc.). This ensures the robustness of the evaluation procedure. Basically, each user's hand should be recorded in completely untreated condition (without any hand-rubbing). On this image, special skin features can be identified, and their locations stored relative the segmented hand of the user. The wireless communication may allow the system to automatically switch to the preset parameters during the image processing, when a calibrated user is approaching it. Otherwise, the software runs with the generic parameter settings (default mode), without specifically edged for the actual user. The database should be managed by the institute and merged with the existing employee data.

Use of the System

The innovation's utility is twofold. Integrated into medical institutes, it can protect both the patients and the medical staff by indirectly enforcing proper and frequent hand washing and compliance with the local regulations. The equipment can greatly support surgeons and hospital staff to reduce nosocomial infection rates. Due to the fact that the device unquestionable determines whether the disinfection procedure was thorough enough, all medical facilities can protect themselves from HAI and consecutive lawsuits by applying this tool.

Second, it can also be used in the medical training: helping medical students to learn effective hand disinfection. Beyond, the general public can also be trained for proper hand hygiene with it. The importance of adequate hand washing has been advocated by many international organizations, including the World Health Organization (WHO Clean Care is Safer Care program, http://www.who.int/gpsc/en/). The use of the device is simple, a digital image of the hand is automatically analyzed after a general hand washing procedure.

The invention claimed is:

1. An apparatus for assessing hand disinfection quality comprising:

a rigid case with a bottom wall, a top wall, and side walls connected to each other, the rigid case further comprising an opening on a front side for introducing hands of a user previously treated with a disinfection medium comprising light reflecting particles, responsive to light mostly outside a visible spectral range of light, in a prescribed manner and for a prescribed time;

wherein the rigid case encloses:

a light source for providing light of a predetermined spectral range for exciting the light reflecting particles on the hands in the rigid case, with an intensity distribution mostly outside the visible range, and an imaging device for taking digital images of the hands, wherein the hands are illuminated from both sides, the imaging device being connected to a computer, wherein the computer is configured for:

determining a concentration of light reflecting particles, comparing a determined concentration value of light reflecting particles with a predetermined threshold value corresponding to an acceptable hand cleanness value, and determining whether a quality of hand disinfection is acceptable or not according to a result of the comparison, wherein the computer is further configured for storing predetermined threshold values for each of individual users, and for comparing the concentration determined with an individual threshold value.

2. The apparatus of claim 1, characterized in that at least two light sources are arranged inside the rigid case in order to provide homogeneous illumination.

3. The apparatus of claim 1, characterized in that the light source comprises UV lamps.

4. The apparatus of claim 1, characterized in that the light source comprises UV LEDs.

5. The apparatus of claim 1, characterized in that the light source comprises IR lamps.

6. The apparatus of claim 1, characterized in that the light source comprises IR LEDs.

7. The apparatus of claim 1, characterized in that the walls of the rigid case are not transparent to light.

8. The apparatus of claim 1, characterized in that the inside surface of the walls of the rigid case is black and non-reflecting.

9. The apparatus of claim 1, characterized in that an inclined surface is applied to the bottom wall for supporting the hands.

10. The apparatus of claim 9, characterized in that the inclined surface is covered with a black non-reflective sheet.

11. The apparatus of claim 1, characterized in that the rigid case is a wall mounted case, wherein the bottom wall is removable.

12. The apparatus of claim 1, characterized in that the individual threshold values are application dependent threshold values.

13. A method for assessing hand disinfection quality comprising the steps of:

providing a hand disinfection medium comprising light reflecting particles responsive to light mostly outside the visible spectral range of light, applying the hand disinfection medium comprising the light reflecting particles in a prescribed manner and for a prescribed time, introducing hands of a person into a rigid case with a bottom wall, a top wall and side walls connected to each other, illuminating the hands disinfected this way with a light source providing light in a predetermined spectral range for activating the light reflecting particles, with an intensity distribution mostly outside the visible spectral range, taking digital images of the illuminated hands from both sides with an imaging device, transferring the digital images from the imaging device to a computer, the computer being configured for:

determining a concentration of the light reflecting particles, comparing a determined concentration value with a predetermined threshold value corresponding to an acceptable hand cleanness, and determining whether a quality of hand disinfection is acceptable or not according to results of the comparison, characterized in that for each person an individual threshold value is stored, and the concentration value determined from the digital image of each person is compared with the individual threshold value.

14. The method of claim 13, characterized in that the digital image is filtered in order to obtain different spectral images, wherein one of the filtered images is used for determining the regions of interest within the digital image for further analysis, and at least one of the other filtered images is used for determining the concentration of light reflecting particles.

15. The method of claim 14, characterized in that the obtained filtered images, the determined values of concentration of the light reflecting particles and the quality control result, are stored in a storage means.

16. The method of claim 15, characterized in that for each person a first set of data, comprising hand images, concentration values before a disinfection procedure and a second set of data comprising hand images, concentration values after the disinfection procedure are stored in the storage means.

* * * * *